US005325927A

United States Patent [19]

Valente

[11] Patent Number: 5,325,927

[45] Date of Patent: Jul. 5, 1994

[54] DEVICE FOR QUENCHING OPEN AIR FIRES

[76] Inventor: Jose Valente, 119 Givins Street, Toronto, Ontario, Canada, M6J 2Y1

[21] Appl. No.: 767,705

[22] Filed: Sep. 30, 1991

[51] Int. Cl.[5] ..... A62C 3/06

[52] U.S. Cl. ..... 169/49; 169/69

[58] Field of Search ..... 169/69, 43, 46, 49, 169/52

[56] References Cited

U.S. PATENT DOCUMENTS

| | | | |
|---|---|---|---|
| 739,377 | 9/1903 | Bell | 169/69 X |
| 1,520,288 | 12/1924 | Featherstone | 169/69 X |
| 3,815,682 | 6/1974 | Chiasson et al. | 169/69 X |
| 4,323,118 | 4/1982 | Bergmann | 169/69 X |

*Primary Examiner*—David M. Mitchell
*Assistant Examiner*—Andrew C. Pike
*Attorney, Agent, or Firm*—Bereskin & Parr

[57] ABSTRACT

A open air fire quencher comprises a vessel having a substantially airtight top and sides and at least a partially open bottom. The open bottom permits placement of the vessel vertically down over a flame source until the bottom rests on a grade surrounding the flame source. The vessel includes an inner quenching chamber and an outer chamber. The outer chamber may be filled with water to absorb the thermal energy from the flame source. The outer chamber includes a drain to allow water to be released downward. The released water assists in forming an airtight seal around the open bottom. The released water further assists in cooling the area surrounding the flame. In a further embodiment the inner chamber has a flame deflector and the vessel includes an extinguishing system for spraying the flame source with an extinguishing substance.

6 Claims, 2 Drawing Sheets

DEVICE FOR QUENCHING OPEN AIR FIRES

FIELD OF THE INVENTION

This invention relates to open air fires, and in particular to the field of devices which may be used to quench or extinguish such open air fires. Such fires may occur in oil or gas wells which have become ignited and are burning in an uncontrolled manner. Typically such fires are very difficult and dangerous to extinguish.

BACKGROUND TO THE INVENTION

It has been well known that hydrocarbon producing wells, such as oil and gas wells, are ignitable. Upon ignition, and damage to the wellhead equipment, such wells become giant open air flames which may burn uncontrolled unless quenched or extinguished. The particular problems associated with this type of fire have been demonstrated in Kuwait with so many oil and gas wells being simultaneously on fire. Such fires create a vast amount of pollution and are a waste of a non-renewable energy source.

In the past, one preferred way of extinguishing an uncontrolled oil or gas well fire was to initiate an explosion adjacent to the flame. During the explosion, the explosive material uses up all free oxygen from the immediately surrounding vicinity which in conjunction with the explosive shock wave deprives the flame of oxygen thereby extinguishing it. However, such a technique requires that a precise amount of explosive be placed in a precise position relative to the flame. This can be difficult to do in a crowded area in which many fires are burning simultaneously. Further, this technique is slow and hazardous since it involves the use of explosive materials in a hot and dangerous environment.

SUMMARY OF THE INVENTION

What is desired is a device which is capable of putting out oil well fires quickly and easily and yet which is not dangerous to use. Preferably, such a device would extinguish the flame by depriving the flame of oxygen. What is also required is a device which could be used safely many times to extinguish many fires, in a reliable manner. What is also required is a device that can overcome re-ignition which may occur if the wellhead area is not cooled once the flame is extinguished.

According to the present invention, there is provided: a device for quenching open air fires comprising: a vessel having a substantially airtight top, and sides, and at least a partially open bottom said open bottom permitting placement of said vessel vertically down over a flame source wherein said bottom rests on a grade surrounding said flame source; said vessel further including an inner quenching chamber and an outer chamber, said outer chamber being fillable with water to absorb thermal energy from said flame source, said outer chamber including means to release any water contained therein downward, said released water assisting in restricting the flow of oxygen into the inner quenching chamber whereby said flame may be starved of oxygen and extinguished.

LIST OF FIGURES

Reference will now be made to the accompanying drawings which, by way of example only, refer to a preferred embodiment of the invention and in which.

DETAILED DESCRIPTION OF PREFERRED EMBODIMENT

Figure 1:
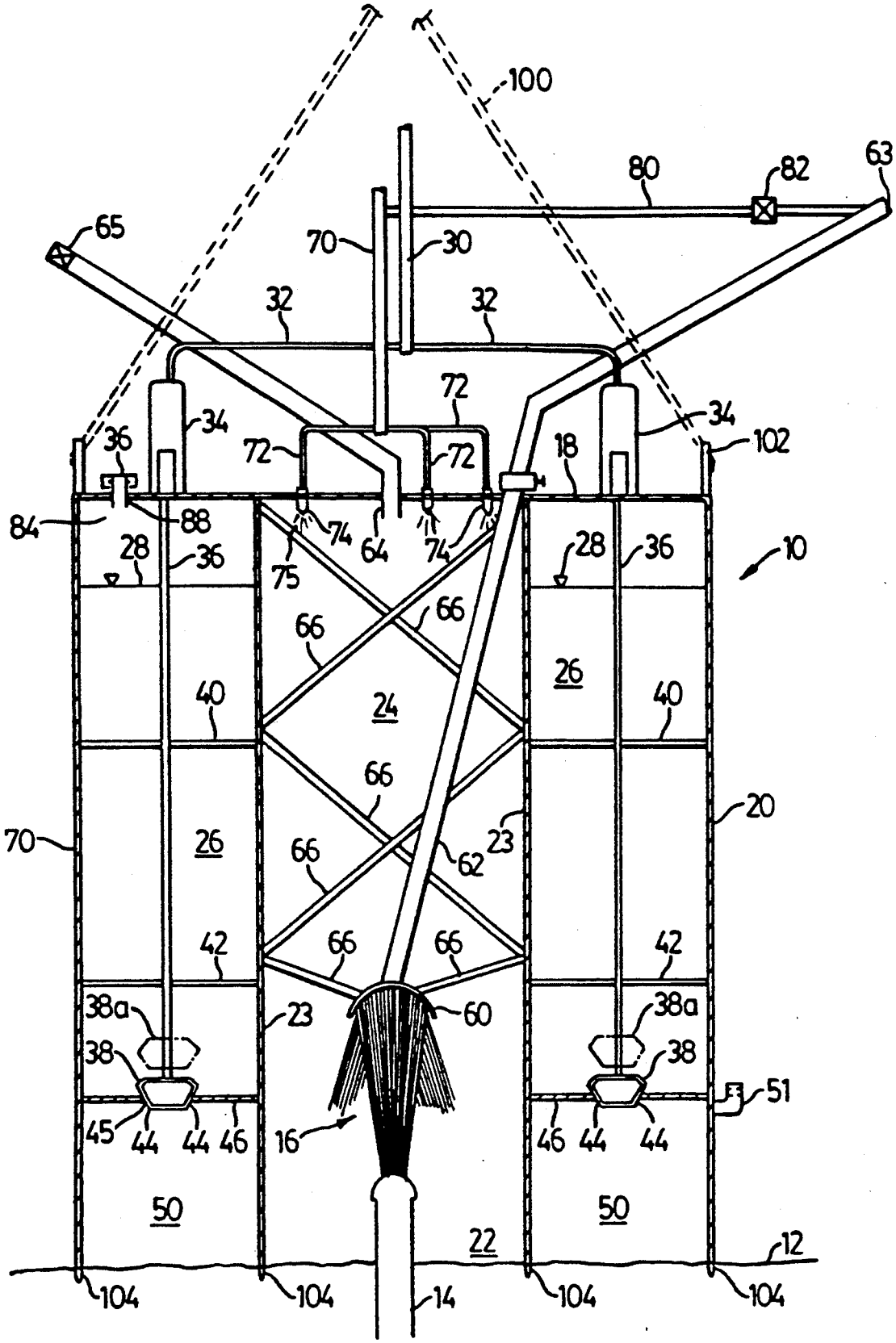
FIG. 1 shows a cross-sectional view of the present invention along line 1—1 of FIG. 2.

FIG. 1 shows a cross sectional view through a vessel 10 according to the present invention. The vessel 10 is shown resting on the ground 12. A oil well pipe 14 extends up from the ground 12 and gushing hydrocarbons such as oil are shown at 16. The vessel 10 is comprised of a top 18, sides 20, and an open bottom 22.

As shown in FIG. 1, the open bottom 22 includes inner wall 23, forming an inner chamber 24 and an outer chamber 26. The inner chamber 24 may be considered as a quenching chamber in that an open flame of the hydrocarbons 16 will be quenched by the device in a manner hereinafter described. The outer chamber 26 is preferably fillable with water which is shown at 28. Although the outer chamber 26 is not shown completely full, as will be described herein, it is fillable up to the top 18.

Also shown is a pneumatic trunk line 30 with branches 32 which lead to actuators 34. Although two actuators 34 are shown in FIG. 1, it is preferable that there be four actuators 34 in total, equally spaced around the top 18. However, more or less pneumatic actuators could be used depending upon the circumstances.

Extending downwardly from actuators 34 are actuator rods 36 which end at plugs 38. Because of the length of actuator rods 36 it is preferable to provide guides 40 and 42. The plugs 38 are formed with sloping sides 44 and seal in openings 45 in a floor 46. It will be now appreciated that chamber 26 is a closed chamber which is fillable with water and which has a plurality of holes located in the bottom wall 46. Upon actuation of the pneumatic actuators 34, the actuator rods 36 are lifted upwardly, pulling plugs 38 as shown in ghost outline at **38*a* out of the openings in the bottom 46 allowing water to drain out of chamber 26**.

Also shown is a lower chamber 50 which is where the water 28 drains into. The lower chamber 50 is preferably significantly smaller than the upper chamber 26 and is described in more detail below. Also shown is a pressure relief valve 51 for chamber 50.

The inner quenching chamber 24 includes a deflector 60 with a blow-off conduit 62 and a pressure relief conduit 64. The deflector 60 is retained in place by cross bracing 66 which crisscrosses the chamber to provide sufficient support to resist the force of the oil or gas 16 being released from the well 14.

Additionally, an extinguishing main or trunk pipe 70 is shown having a plurality of branch lines 72 which lead to extinguishing nozzles 74. The extinguishing line 70 transports extinguishing substances 75 for injection by nozzles 74 into the inner chamber 24. Such extinguishing substances 75 could include gases, foams, or liquids. Such extinguishing substances will be chosen in accordance with the type of open flame to be extinguished and will be known to those skilled in the art.

At the end of pressure outlet pipe 64 is a pressure relief valve 65 which is a one-way valve. Upon an increase in pressure in the inner chamber 24 gases will be allowed to escape out the outlet 64 through one-way valve 65 and yet the ingress of air containing fresh oxygen will be prevented by the valve 65.

In addition the blow-off pipe 62 will provide a conduit up from the deflector 60 whereby extinguished oil under the force of pressure from the well will be carried out through pipe 62 and ejected at the end 63. In some cases it may be that the oil is so hot that it may re-ignite out of exit 63. Therefore, an additional conduit 80 is provided off of the extinguishing system 70 which can be used to inject extinguishing substances 75 adjacent the end 63 of the oil release conduit 62. The conduit 80 includes a remotely actuable valve 82 for selectively releasing extinguishing substances into the conduit 62 as desired. It is to be noted that the joint between conduit 80 and pipe 62 is somewhat upstream of the exit 63. This is to better facilitate extinguishing any flame which occurs at exit 63.

Figure 2:
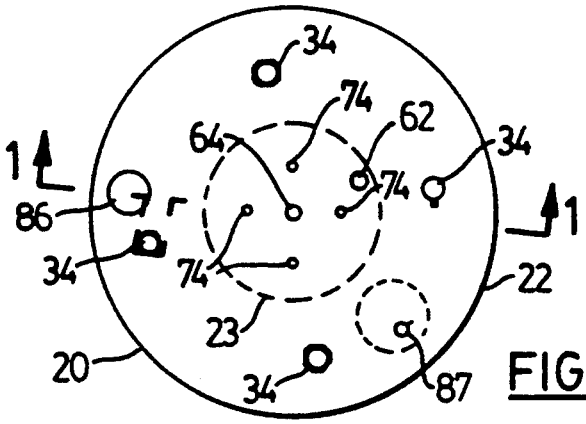
FIG. 2 shows a top view of the invention of FIG. 1.

In FIG. 2 it can be seen that in the preferred embodiment the vessel 10 is circular in outer shape. FIG. 2 is a top view which shows that the side 20 is circular and shows that the wall 23 of the chamber 24 is also circular. Also shown are the four nozzles 74 and the central vent pipe 64. Also shown are the actuators 34 and a vent 84 for the chamber 26. The vent 84 comprises a cap 86 which sits upon an outlet pipe 88. Upon there being sufficient vapour pressure within the chamber 26, the cap 86 will lift off the end of the pipe 88 and steam will be released. Also shown is the exit orifice for the conduit 62 as well as the inner wall 23 of the inner quenching chamber 24. The vent 84 also facilitates filling the outer chamber 26 with water. Also shown is manual inspection port 85, which has a handle 87 for lifting, together with an opening sized to allow a person to descend into chamber 26.

Figure 3:
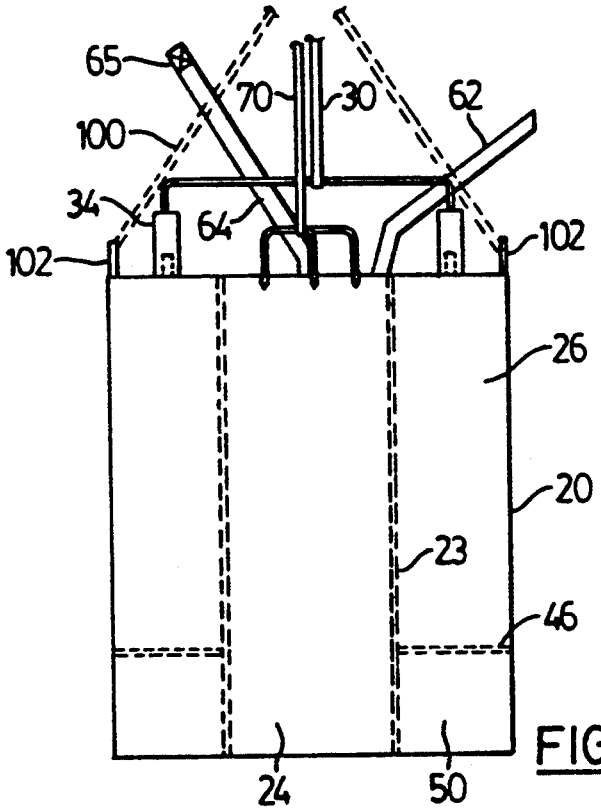
FIG. 3 shows a side view of the invention of FIGS. 1, and 2.
Figure 4:
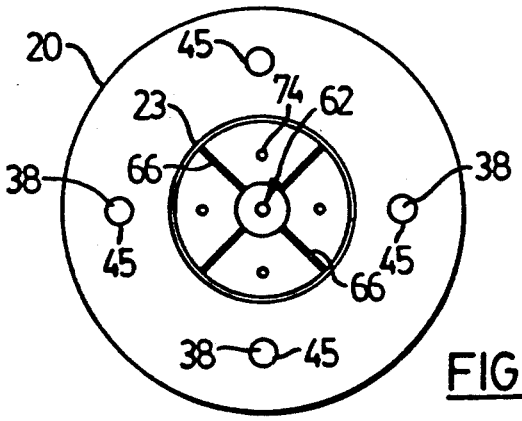
FIG. 4 shows a bottom view of the invention of FIGS. 1, 2, and 3.

FIGS. 3 and 4 show side and bottom views respectively of the vessel 10.

As shown in FIGS. 3 and 4, the bottom chamber 50 is a ring-shaped chamber which surrounds the inner quenching chamber 24 around its outer periphery. Also, preferably the side wall 20 and inner wall 23 are substantially knife edged at the bottom to facilitate the penetration of the vessel 10 partially into the ground when in position around the open flame. Such penetration assists in the sealing against the flow of any air, and thereby any oxygen into the inner quenching chamber 24.

The manner of operation of the instant invention can now be understood. In the event than an oil well 14 is burning in an uncontrolled fashion, the vessel 10 can be lifted by an ordinary crane by means of lifting lines 100 which are attached to the vessel 10 by lifting lugs 102. The crane operator can then position the vessel above the flame to be extinguished. The operator will then lower the vessel 10 down onto the flame such that the flame source impacts upon the deflector 60. It is preferable if the water fillable chamber 26 is completely filled with water at this time. In the preferred embodiment, the fillable chamber 26 has a capacity for 4,000 to 5,000 liters of water which provides in addition to a substantial heat absorbing capacity a substantial weight to the vessel 10. The weight assists in causing the vessel 10 to be securely seated against the upward pressure of the flame and oil, and allows the vessel 10 to partially penetrate into the ground 12, if the ground 12 is soft enough, so that the knife edges of the walls 23 and 20 cut off the flow of oxygen into the inner quenching chamber as illustrated in FIG. 1 at 104.

The operator will then evaluate whether the flame is being extinguished by monitoring the nature of the material exiting the pipe 64. If it becomes apparent that the flame is not going out, or that the vessel has not made a good seal with the ground the operator can cause the actuators 34 to lift the plugs 38. This allows the water from chamber 26 to drain past the plug 38 into the chamber 50. This water will then spread over the ground 12 in the chamber 50 and cool the ground. Additionally, the water will seep into the ground, which is in most cases likely to be porous, and will form an additional sealing action against the ingress of oxygen through the soil. Provided that the release of water from the chamber 26 occurs at a greater rate than the penetration of the water into the ground 12, a low level of water can always be maintained at the bottom of chamber 50 thereby effectively sealing chamber 50 against any inflow of oxygen and allowing the flame source at the well 14 to be quenched.

The vessel 10 may need to be left on the well 14 for a sufficient period of time to allow any wellhead metal or other objects within the inner quenching chamber 26 to become cool enough to prevent re-ignition of the wellhead. However, with the vast flows of hydrocarbon or oil 16 that come out of the well 14 this cooling action of any such over-heated metal or other ground will take place fairly rapidly. Ignition problems are avoided since as long as the vessel is in place, no oxygen will be permitted into the quenching chamber, until everything is sufficiently cool. In any event, with the exit pipe 63 there will always be the ability to drain off excess oil released from the oil well 14 to prevent the vessel 10 from moving. Once the cooling by reason of the passing oil has sufficiently cooled the area around the wellhead, then the vessel 10 can be lifted, again by the same crane and removed from the site.

If necessary, to assist in quenching the flame, the nozzles 74 can be used to spray extinguishing substances on the flame and on the back of the deflector 60 to cool the same. The bracing 66 has the additional effect of transmitting heat from the inner chamber 26 to the side wall 23 which of course will be cooled by the water in the chamber 26.

Although the size of the vessel 10 can be varied to suit certain sizes of fires, a preferred vessel size is twelve feet in diameter. The inner chamber is preferably five feet in diameter, and the outer chamber is preferably three and a half feet in width. The preferred height is fourteen feet, with the floor of the outer chamber located between under five feet from the open bottom, for example three feet. A preferred material for the vessel is five-sixteenth of an inch thick steel, although in certain applications a thicker grade of steel may be appropriate.

It will be appreciated by those skilled in the art that various modifications can be made to the instant invention without departing from the scope of the appended claims. Some of these modifications are discussed above and others will be apparent, such as varying the external shape of the vessel 10. However, the discussion of the preferred embodiment is by way of example only, and the scope of the invention is defined by the appended claims.

I claim:

1. A device for quenching open air fires comprising a vessel having:

(i) a substantially airtight top and sides;

(ii) at least a partially open bottom permitting placement of said vessel vertically down over a flame source wherein said bottom rests on grade surrounding said flame source;

(iii) an inner quenching chamber; and (iv) an outer chamber including:

(a) a lower outer chamber;

(b) an upper outer chamber which is fillable with a liquid sealing means to absorb thermal energy from a flame emanating from said flame source;

(c) a floor between said upper outer chamber and said lower outer chamber; and (d) a means to release said liquid sealing means into the lower outer chamber comprising at least one remotely actuable plug for selectively sealing an opening in said floor, and an actuator for unseating said plug from said opening;

wherein said released liquid sealing means partially fills said lower outer chamber to form a temporary airtight seal between said lower outer chamber and said grade whereby said flame may be starved of a source of oxygen and extinguished.

2. A device as claimed in claim 1 wherein said actuator includes a pneumatic valve and a shaft connected at one end to said pneumatic valve and at another end to said plug and wherein upon actuation said pneumatic valve raises and lowers said shaft and thereby seats and unseats said plug in said opening.

3. A device as claimed in claim 2 wherein said outer chamber further includes at least one guide for said shaft, to assist said plug in registering with said opening in said floor of said outer chamber.

4. A device as claimed in claim 3 further including a deflector which is centrally supported in said inner quenching chamber by a plurality of support members.

5. A device as claimed in claim 4 wherein said inner and outer chambers include pressure release valves.

6. A device as claimed in claim 1 wherein said liquid sealing means substantially comprises water.

* * * * *